US008528973B2

(12) United States Patent
Sander et al.

(10) Patent No.: US 8,528,973 B2
(45) Date of Patent: Sep. 10, 2013

(54) ADJUSTING MECHANISM FOR ADJUSTING A RESTORING FORCE THAT ACTS ON A BACKREST OF A CHAIR, AND OFFICE CHAIR WITH SUCH AN ADJUSTING MECHANISM

(71) Applicant: Sidiz Inc., Seoul (KR)

(72) Inventors: Armin Sander, Fuerth (DE); Christopher Schmidt, Nuremberg (DE)

(73) Assignee: Sidiz, Inc., Seoul (KR)

( * ) Notice: Subject to any disclaimer, the term of this patent is extended or adjusted under 35 U.S.C. 154(b) by 0 days.

(21) Appl. No.: 13/651,811

(22) Filed: Oct. 15, 2012

(65) Prior Publication Data

US 2013/0038105 A1 Feb. 14, 2013

Related U.S. Application Data

(63) Continuation of application No. PCT/EP2011/001858, filed on Apr. 13, 2011.

(30) Foreign Application Priority Data

Apr. 15, 2010 (DE) ..... 20 2010 005 037 U

(51) Int. Cl.
*A47C 1/024* (2006.01)

(52) U.S. Cl.
USPC ..... 297/303.1; 297/303.4; 297/300.5

(58) Field of Classification Search
USPC ..... 297/300.3, 300.4, 300.5, 303.1, 303.4
See application file for complete search history.

(56) References Cited

U.S. PATENT DOCUMENTS

| | | | | |
|---|---|---|---|---|
| 4,411,469 | A * | 10/1983 | Drabert et al. | 297/300.2 |
| 4,684,173 | A * | 8/1987 | Locher | 297/300.3 |
| 4,966,411 | A * | 10/1990 | Katagiri et al. | 297/300.7 |
| 5,207,479 | A * | 5/1993 | Wickman et al. | 297/303.4 |
| 6,709,056 | B2 * | 3/2004 | Bock | 297/300.4 |
| 7,147,285 | B2 * | 12/2006 | Lin | 297/301.1 |
| 7,488,040 | B2 | 2/2009 | Dozsa-Farkas | |
| 7,530,637 | B1 * | 5/2009 | Wu | 297/300.5 |

FOREIGN PATENT DOCUMENTS

DE 90 02 416 U1 5/1990

OTHER PUBLICATIONS

International Search Report of PCT/EP2011/001858.

* cited by examiner

*Primary Examiner* — David Dunn
*Assistant Examiner* — Timothy J Brindley
(74) *Attorney, Agent, or Firm* — Lawrence A. Greenberg; Werner H. Stemer; Ralph E. Locher

(57) ABSTRACT

An adjusting mechanism is used to adjust a restoring force that acts on a backrest of a chair. The adjusting mechanism has a spring element for creating the restoring force, a support, and a backrest support that is pivotably mounted about a support axis on the support. An adjusting element configured as a pair of scissors containing a first scissor arm and a second scissor arm is provided, and the scissor arms are rotatably connected to each other about a scissor axis. The first scissor arm is pivotably mounted on the backrest support about an adjusting axis. A spring force produced by the spring element acts on the second scissor arm. A first actuating lever length is defined between the support axis and the scissor axis. The lever length is changeable using an adjusting element for adjusting the restoring force by pivoting the adjusting element about the adjusting axis.

14 Claims, 8 Drawing Sheets

ADJUSTING MECHANISM FOR ADJUSTING A RESTORING FORCE THAT ACTS ON A BACKREST OF A CHAIR, AND OFFICE CHAIR WITH SUCH AN ADJUSTING MECHANISM

CROSS-REFERENCE TO RELATED APPLICATION

This application is a continuation, under 35 U.S.C. §120, of copending international application No. PCT/EP2011/001858, filed Apr. 13, 2011, which designated the United States; this application also claims the priority, under 35U.S.C. §119, of German patent application No. DE 20 2010 005 037.5, filed Apr. 15, 2010; the prior applications are herewith incorporated by reference in their entireties.

BACKGROUND OF THE INVENTION

Field of the Invention

The invention relates to an adjusting mechanism for setting a restoring force which acts on a backrest of a chair. The adjusting mechanism has a spring element for generating the restoring force, a support and a backrest support which is mounted on the support such that it can be pivoted about a support pin. Furthermore, the invention relates to an office chair having an adjusting mechanism of this type.

The office chair is preferably equipped with what is known as a synchronizing mechanism. In chairs of this type, the inclination of the backrest can usually be adjusted counter to a restoring force. It is provided in the case of comfort chairs that the restoring force can be set, in order to adapt it to the requirements of users of different weights.

Here, different mechanisms and methods are possible for setting purposes. Thus, for example, the prestress of a spring which exerts the restoring force can be capable of manual setting via an actuating element, such as a handwheel. In order for it to be possible to adjust the spring prestress, a very high force is required, however, with the result that a complicated step-up mechanism is usually required, which also leads to it being necessary for a comparatively large number of revolutions to be carried out, in order to achieve a perceptible adjustment.

As an alternative, it can be provided to configure an entire spring assembly arrangement or, in general, the arrangement of the spring element to be pivotable, with the result that the articulation points of the spring element in the force parallelogram are changed. However, this requires a relatively large amount of installation space, since the entire spring element has to be pivoted.

In addition, known setting possibilities have the problem that the ratio of the initial force exerted by the spring element (in the rest position) to the maximum force (in the inclined position) often behaves unfavorably in the case of a performed weight setting. In other words, this means that the restoring force which is exerted by the spring element via the inclination adjustment of the backrest is perceived differently by a light person and a heavy person, for example in such a way that, in the case of a light person, a soft setting which is first of all perceived as pleasant is perceived as more and more sluggish as the inclination increases, and vice versa in the case of a heavy person, for example. There is therefore the problem of correct setting beyond the adjustment of the inclination of the backrest.

Furthermore, adjusting mechanisms are known from the prior art which, in order to set the restoring force, provide a change in an active lever length between a rotational axis of the backrest support and an action point of the spring element. Thus, for example, in the mechanism which is known from international patent disclosure WO 2006/114250 A1, corresponding to U.S. Pat. No. 7,850,237, a roller is adjusted with the aid of a setting lever, which roller is first guided along a surface on the backrest support and second along a surface of a pivoting lever, the roller and the pivoting lever moderating between the action point of the spring element and the backrest support in order to set different active lever lengths.

An adjusting mechanism can be gathered from published, European patent application EP 1 258 212 A2, in which adjusting mechanism the action point of a spring element on the back support can be adjusted in order to change an active lever length between the action point and the pivot pin. In a similar way, EP 1 258 211 A2 describes a bearing block which can be displaced along a sliding guide in order to set different active lever lengths.

SUMMARY OF THE INVENTION

It is accordingly an object of the invention to provide an adjusting mechanism for adjusting a restoring force that acts on a backrest of a chair, and an office chair with such an adjusting mechanism which overcome the above-mentioned disadvantages of the prior art devices of this general type, which has an improved adjusting mechanism for setting the restoring force in a chair of this type, in particular a chair having a synchronizing mechanism.

According to the invention, the object is achieved by an adjusting mechanism having the features of the claims and by an office chair having an adjusting mechanism of this type. The adjusting mechanism is generally configured for setting a restoring force which acts on a backrest of a chair. To this end, the adjusting mechanism has a spring element for generating the restoring force and a support and a backrest support which is mounted pivotably on the latter.

In order to set the restoring force in a weight-dependent manner, an adjusting element which is configured in the manner of scissors is provided with a first and a second scissor arm, the scissor arms being connected to one another such that they can be rotated about a scissor pin. The first scissor arm is mounted on the backrest support such that it can be pivoted about a setting pin. A spring force which is exerted by the spring element acts on the second scissor arm. An active lever length is defined between the support pin and the scissor pin, which active lever length can be changed with the aid of a setting element for setting the restoring force, by the adjusting element being pivoted about the setting pin. The spring element therefore generally acts merely indirectly on the backrest support via a type of chain of multiple links and, in particular, is decoupled from the movement of the backrest support. Here, the setting element forms a transmission element for the transmission of the spring force to the backrest support. The spacing and therefore the active lever length between the scissor pin and the support pin are varied in a simple way by rotation of the entire scissors about the setting pin. The spring force which is exerted by the spring element is deflected in a multiple link manner via the adjusting element and is transmitted as the restoring force to the backrest support. If the active lever length is selected via the setting element, the position of the scissor pin in relation to the support pin is preferably fixed, that is to say the active lever length is fixed unchangeably during an adjusting operation. The scissors then act overall in the manner of a mechanical articulated arm linkage for transmitting the spring force.

In contrast to conventional adjusting mechanisms, the spring element therefore does not act directly on the lever arm, and the spring element therefore does not need to have its action point changed in order to set different lever arms.

In one preferred embodiment, the spring element always acts on the same position within the adjusting mechanism independently of the selected weight-dependent setting, and its position is also unchangeable, in particular, in the case of an adjustment of the inclination. This is achieved via the scissors and the decoupling of the action point of the spring element from the setting of the lever arm length. This also results, in particular, in the decisive advantage that, in the case of an adjustment of the inclination, the exerted spring force is constant over the entire inclination travel. A user therefore perceives a uniform restoring force over the entire travel of the adjustment of the inclination, with the result that great comfort is achieved overall.

According to one expedient development, the adjusting mechanism is configured in such a way that, in an unloaded basic position, that is to say, in particular, in the case of a position of the backrest support in which a backrest which is fastened to it is in an upright initial position, the two scissor arms extend at least largely and preferably exactly parallel to one another. The two scissor arms are therefore aligned with one another. Since the end of the first scissor arm is mounted pivotably on the backrest support in order to adjust the active lever length and, at the same time, the spring force acts on the end side of the second scissor arm, there is an as far as possible force-free mounting about the setting pin as a result of the parallel orientation of the two scissor arms. Merely frictional forces, but not the spring force which is exerted by the spring force, counteract an adjusting movement about the setting pin. As a result, very simple, unloaded setting of the active lever length is made possible for the user. The two scissor arms are therefore overall oriented with respect to one another in such a way that a force-free adjustment of the adjusting element is possible.

In one expedient development, the spring element acts on the second scissor part merely indirectly via an articulation element, the articulation element being connected to the scissor part such that it can be pivoted about an articulation pin. Here, the articulation pin is configured, in particular, at that end of the second scissor arm which lies opposite the scissor pin. In the basic position, the articulation pin and the setting pin are preferably aligned exactly with one another.

In an expedient way, the articulation element is itself in turn mounted on the support such that it can be rotated about a further pivot pin, the spring element exerting a torque on the articulation element with regard to a rotation about the pivot pin.

Whereas the first scissor arm is articulated on the backrest support, the second scissor arm is therefore generally connected to the support. In the preferred variant with the articulation element, this takes place indirectly via the articulation element. The linearly acting spring force of the spring element is therefore first of all converted via the articulation element into a rotational movement with a corresponding torque and is transmitted via the multiple link coupling to the backrest support in order to exert the restoring force.

With regard to a compact overall design, the articulation element preferably has an indentation, into which the scissor pin can pivot in order to vary the active lever length. Here, the articulation element is overall of C-shaped or U-shaped configuration.

In order to set the active lever length, in one preferred embodiment, a locking element is provided for fixing the active lever length which is set via the setting element, with the result that the active lever length is unchangeable even in the case of an adjustment of the inclination. Here, the locking element is expediently active automatically after a setting has taken place, without it requiring an additional operation by the user. The setting element is generally configured for manually setting the lever length and is, for example, a handwheel, a lever or the like. The setting element and the locking element are coupled to one another. The setting element preferably has a self-locking spindle as locking element. The active lever length is therefore set via the spindle by way of a rotational adjustment. The spindle acts with its one end on the scissor pin and is supported with its other end on the backrest support, preferably on the support pin.

In the case of a fixed lever length, that is to say after setting has taken place via the setting element, the position of the different pivot pins, namely support pin, setting pin and scissor pin, is fixed mechanically with respect to one another; to this extent, they therefore form a type of mechanically rigid triangle, via which the force is transmitted.

With regard to a compact embodiment, the pivot pin is arranged below the support pin and the scissors are arranged between the two articulation points. Here, below and above relates to the usual positions in a chair, that is to say below is to be understood as the orientation in the direction of the seat surface and below is to be understood as the orientation toward the floor.

As a result of the special embodiment, a second active lever length is configured between the pivot pin and the second scissor arm, which second active lever length is defined as perpendicular from the pivot pin to the second scissor arm. Here, the second active lever length is likewise variable during the pivoting of the adjusting element about the setting pin and behaves in the opposite direction with respect to the first active lever length.

The positions of the support pin, to which the backrest support is fastened, and the pivot pin, to which the articulation element is fastened, are fixed in position with regard to the support, since they are mounted on the latter. The spacing between the two pins is therefore constant at all times.

The support is generally preferably configured in the manner of a shell with side walls which lie opposite one another, part of the elements of the adjusting mechanism being received in the shell interior. The individual above-described elements, such as scissors with the articulation element, are preferably present here in double configuration and so as to lie opposite one another in the region of the side walls of the support. Here, the scissor arms and the articulation element are configured as flat plate-like components which are mounted in each case via shafts on one another or on the support or on the backrest support, the shafts defining the individual pins. The spring element is configured, in particular, as a compression spring. It acts, in particular, on an action shaft, coupled to the articulation element. It is fastened with the other end to the front-side end of the support via a supporting shaft. Here, the spring element is mounted such that it can be rotated about the supporting shaft, in order, in the case of an adjustment of the inclination, to adjust the articulation element which can be pivoted about the pivot pin.

Other features which are considered as characteristic for the invention are set forth in the appended claims.

Although the invention is illustrated and described herein as embodied in an adjusting mechanism for adjusting a restoring force that acts on a backrest of a chair, and an office chair with such an adjusting mechanism, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1B:
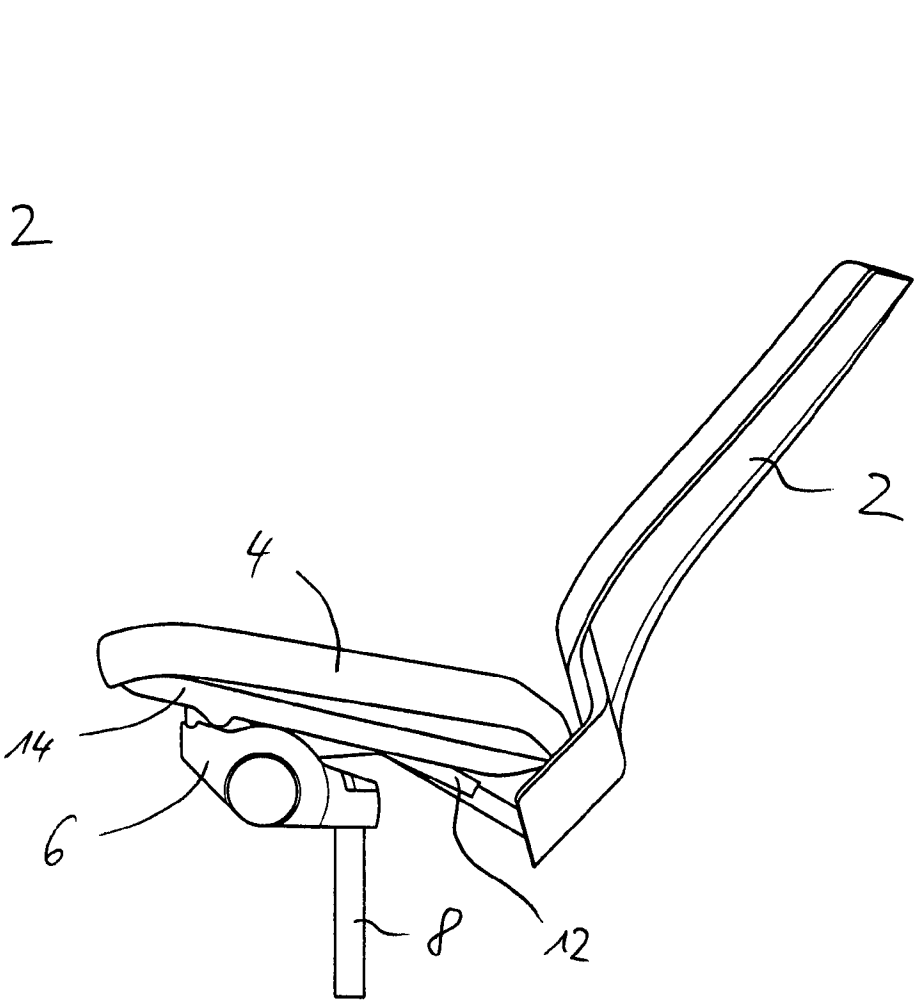
FIG. 1B is a side view of the office chair according to FIG. 1A in a loaded state with an inclined backrest.
Figure 1A:
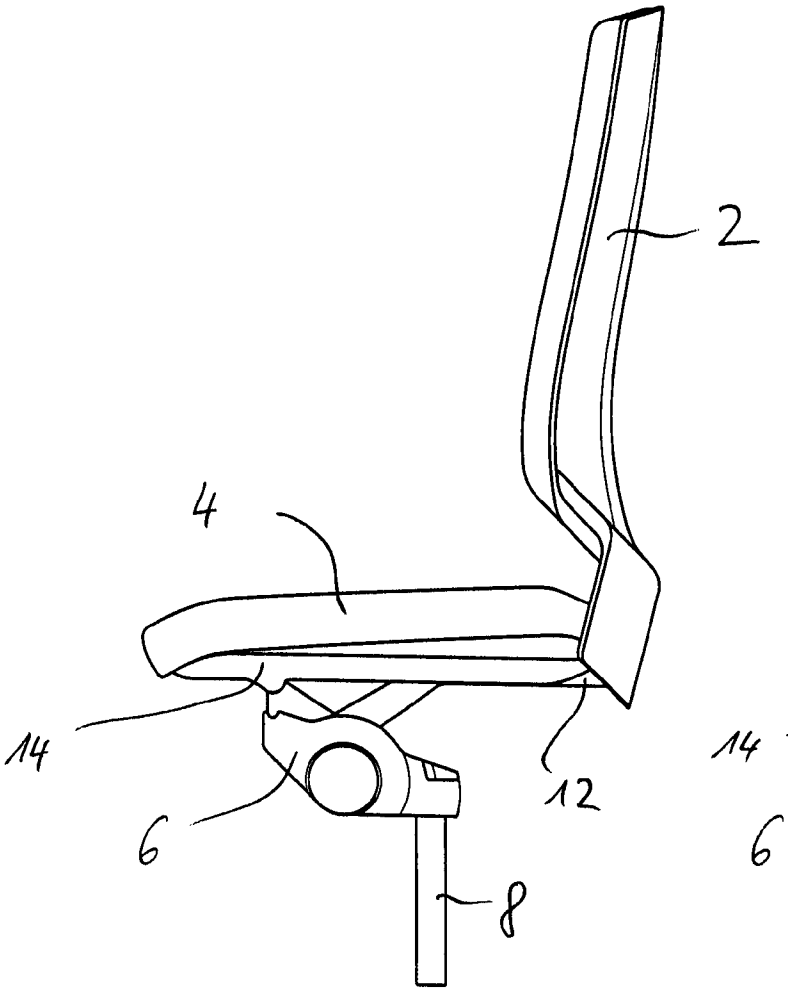
FIG. 1A is a diagrammatic, side view of an office chair with a synchronizing mechanism according to the invention.

Referring now to the figures of the drawing in detail and first, particularly, to FIGS. 1A and 1*b* thereof, there is shown an office swivel chair with a synchronizing mechanism containing a back 2, a seat 4, a seat mechanism or adjusting mechanism 6 which is arranged below the seat 4 and in which the individual components for setting a restoring force which acts on the back 2 are integrated. Furthermore, a standing tube 8 can be seen which is connected to a non-illustrated foot part. The standing tube is usually configured as a telescopic tube, via which a height setting can be performed. A movement of the seat 4 and that of the back 2 are coupled to one another by way of the synchronizing mechanism. To be precise, in the case of an adjustment of the back 2 from the position shown in FIG. 1A into the position shown in FIG. 1B, the seat 4 is transferred from a substantially horizontal orientation according to FIG. 1A into an obliquely rearwardly inclined position.

The synchronizing mechanism contains a back support 12, via which the back 2 is fastened. Furthermore, the synchronizing mechanism contains a seat support 14 which carries the seat 4.

Figure 2A:
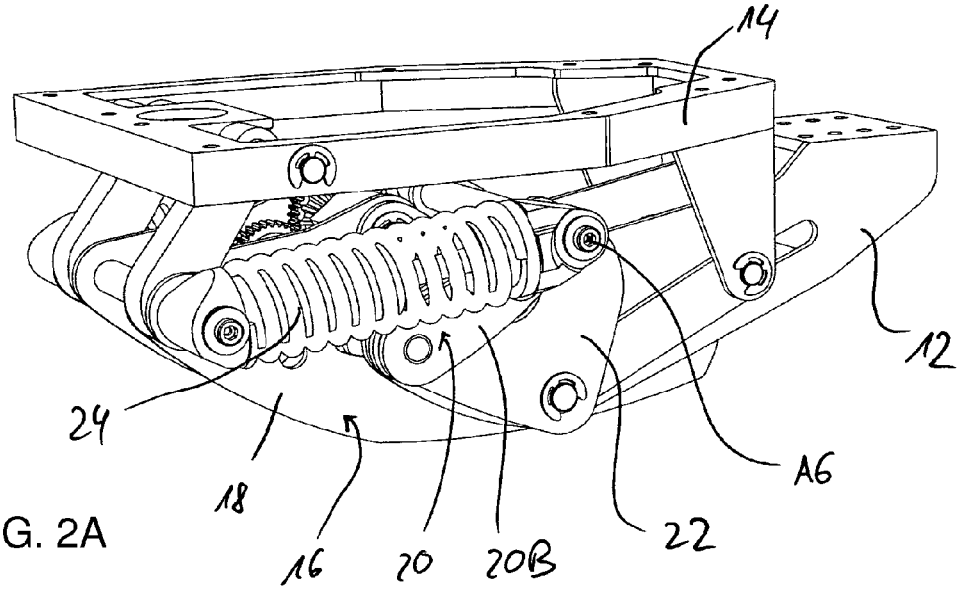
FIG. 2A is a diagrammatic, perspective view of an adjusting mechanism with a back support and a seat support in a basic position (upright back)
Figure 2B:
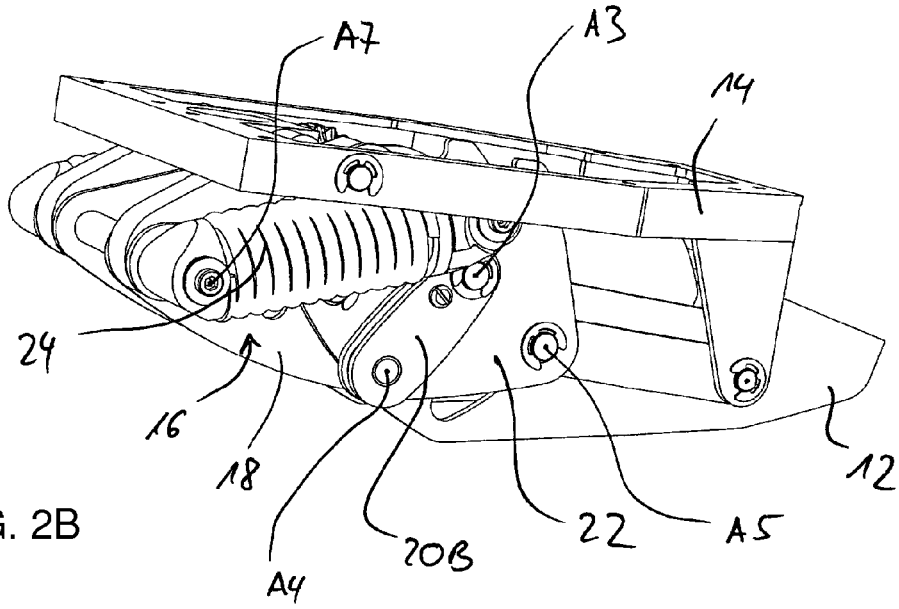
FIG. 2B is a perspective view according to FIG. 2A in an inclined position.
Figure 3:
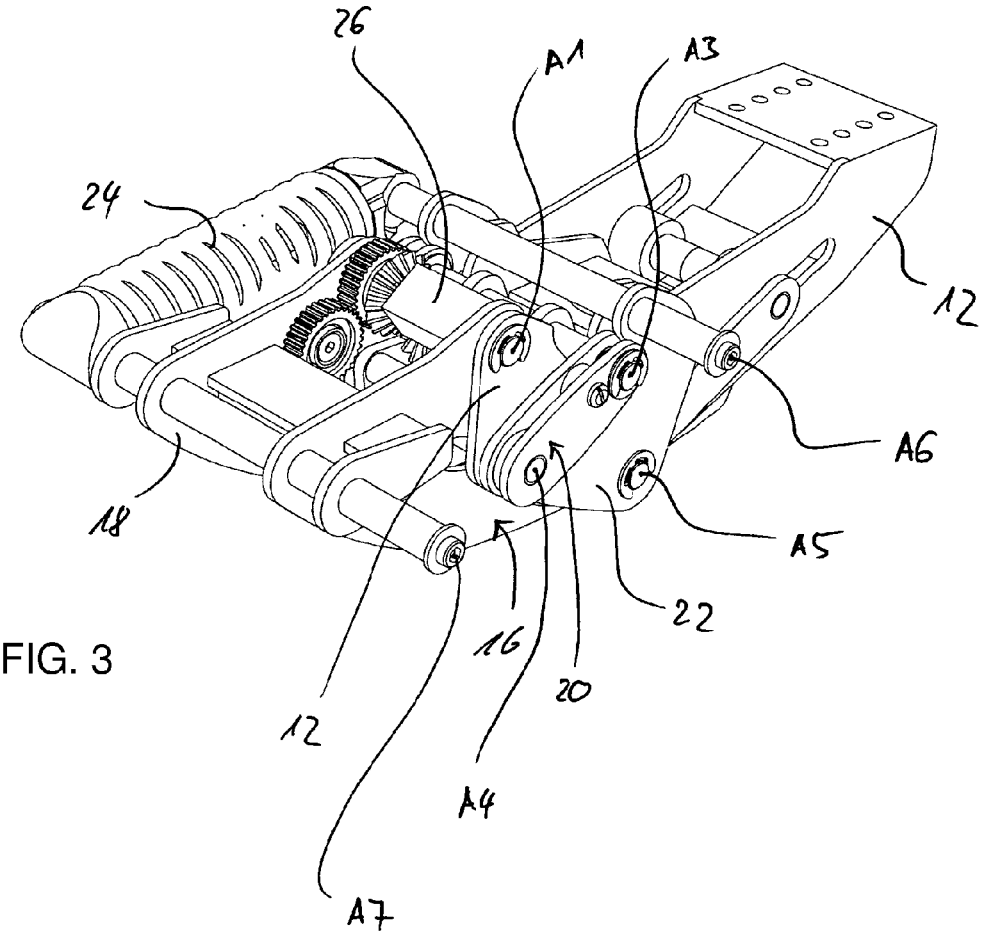
FIG. 3 is a perspective view of the adjusting mechanism of FIGS. 2A and 2B without the seat support and without a right-hand-side spring element.

As can be gathered from FIGS. 2A to 5C, the adjusting mechanism 6 contains a housing which is of a shell-like configuration in the exemplary embodiment and is called a support 16 in the following text. The seat support 14 and the backrest support 12 (called back support for short in the following text) are fastened to the support 16 (FIGS. 2A, 2B). Here, the back support 12 is articulated such that it can be pivoted about a support pin A1 which is defined by a support shaft. The support 16 has two side cheeks 18 which enclose a central space between them.

The adjusting mechanism 6 contains an adjusting element 20 which is configured in the manner of scissors with a first scissor arm 20A (see in particular, FIGS. 4B, 5B) and with a second scissor arm 20B. The first scissor arm 20A is mounted on the backrest support 12 such that it can be pivoted via a setting shaft which defines a setting pin A2 (FIGS. 4B, 4C, 5B, 5C). The two scissor arms 20A, 20B are connected to one another via a scissor bolt which defines a scissor pin A3. The second scissor arm 20B is connected to an articulation element 22 via an articulation bolt which defines an articulation pin A4. The articulation element 22 is connected pivotably movably to the support 16 via a pivoting shaft which defines a pivot pin A5 (see for example, FIGS. 4A, 4B). The articulation element 22 is connected to a spring element 24, a compression spring in the exemplary embodiment, via an action shaft which defines an action pin A6. The spring element 24 is supported with its opposite end on a supporting shaft which defines a supporting pin A7. Here, the supporting shaft is held in the front region of the support 16.

A (first) active lever length W1 is defined between the support pin A1 and the scissor pin A3 (see FIGS. 4A, 4C and 5A, 5C). A (second) active lever length is defined from the pivot pin A5 to the second scissor arm 20B, that is to say as perpendicular to the connecting line between the scissor pin A3 and the articulation pin A4.

In order to adjust the active lever length W1, an adjusting mechanism is provided which can be actuated manually via a handwheel (not shown here in greater detail). The setting mechanism contains a self-locking spindle mechanism 26 with a spindle which is guided in a spindle nut. The spindle nut is connected to the first scissor arm 20A, in order to adjust the latter in the case of an actuation of the handwheel about the setting pin A2. The spindle mechanism is actuated with the aid of the mentioned handwheel, via a plurality of gearwheels which interact in the manner of a gear mechanism in the exemplary embodiment. In principle, other embodiments of the adjusting mechanism are also possible.

The scissor arms 20A, 20B are configured as plates and, in particular, bar-shaped components. Here, the second scissor arm 20B is formed by a double bar in the exemplary embodiment. It is arranged outside the side cheek 18, whereas the first scissor arm 20A is arranged in the central part within the shell which is defined by the support 16. Here, the two scissor arms 20A, 20B extend parallel to the side cheeks 18.

The articulation element 22 is also configured as a plate-shaped element and is arranged outside the side cheek 18 like the second scissor arm in the exemplary embodiment. As can be seen in the figures, most of the components are of double configuration, that is to say essentially a mirror-image arrangement is provided with regard to a center plane through the support 16 of the individual components. This applies, in particular, to the scissor arms 20A, 20B of the articulation element 22, and to the spring elements 24. Here, the component pairs are usually connected to one another via the respective shafts or bolts which are arranged in each case parallel to one another and so as to run transversely.

Figure 4A:
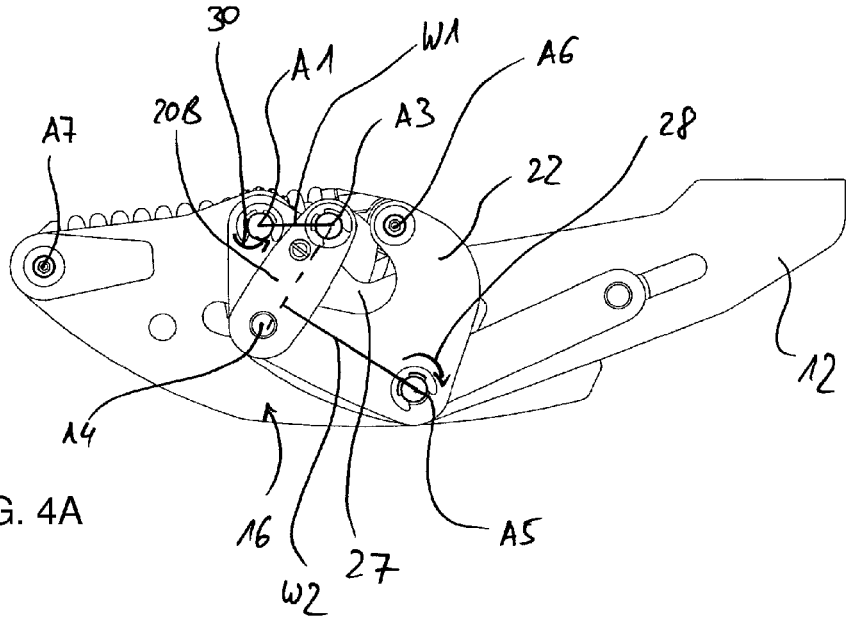
FIG. 4A is a side view from the outside of the adjusting mechanism shown in FIG. 3, with a "light" weight setting in a basic position.
Figure 5A:
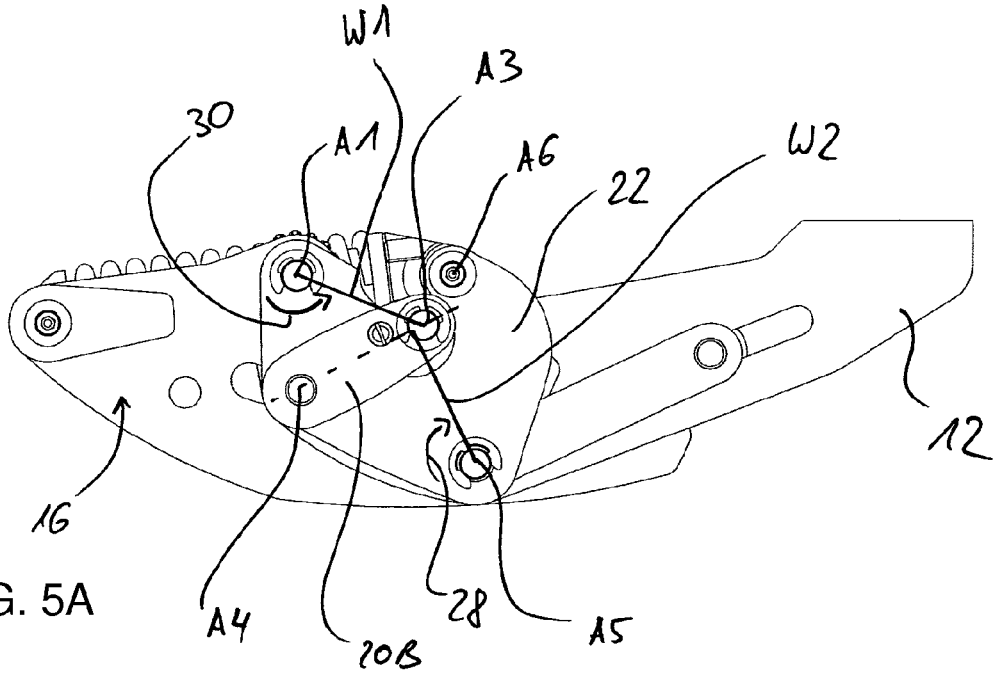
FIGS. 5A to 5C are illustrations which correspond to FIGS. 4A to 4C with a "heavy" weight setting.

In the exemplary embodiment, the articulation element 22 is of approximately C-shaped configuration with an indentation 27, into which the setting pin A2 can pivot during a setting of the active lever length W1 (in this regard, see, for example, FIGS. 4A, 5A). The pins (pivot pin A5, articulation pin A4 and action pin A6) which interact with the articulation element 22 lie at the corners of an imaginary triangle. In the exemplary embodiment, the action pin A6 is arranged at the top point of the articulation element 22, and the pivot pin A5 is arranged at the bottom point. In the exemplary embodiment, the action pin A6 is arranged approximately at the level of the support pin A1. The articulation pin A4 and the pivot pin A5 are therefore arranged below the support pin A1.

Figure 4B:
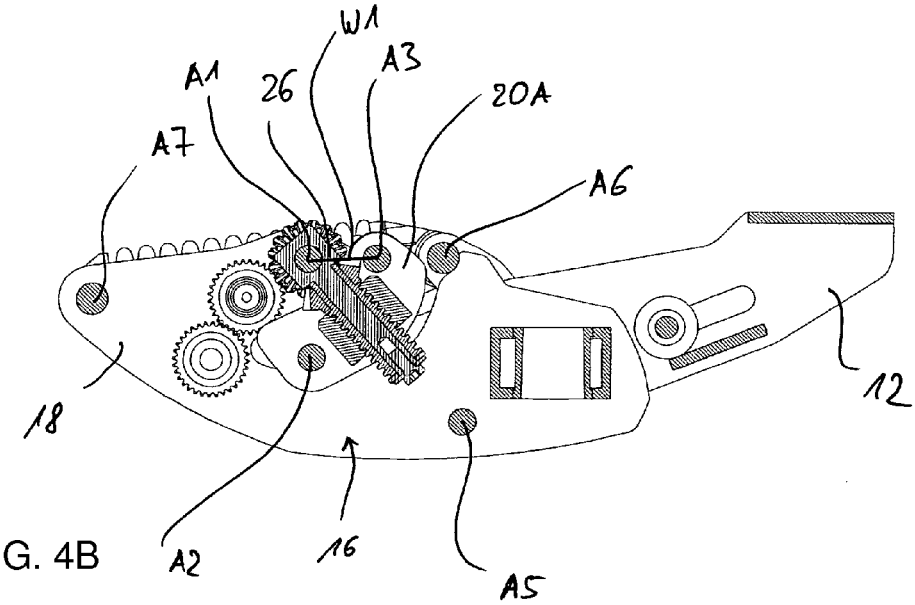
FIG. 4B is a sectional view of the adjusting mechanism according to the position shown in FIG. 4A.
Figure 4C:
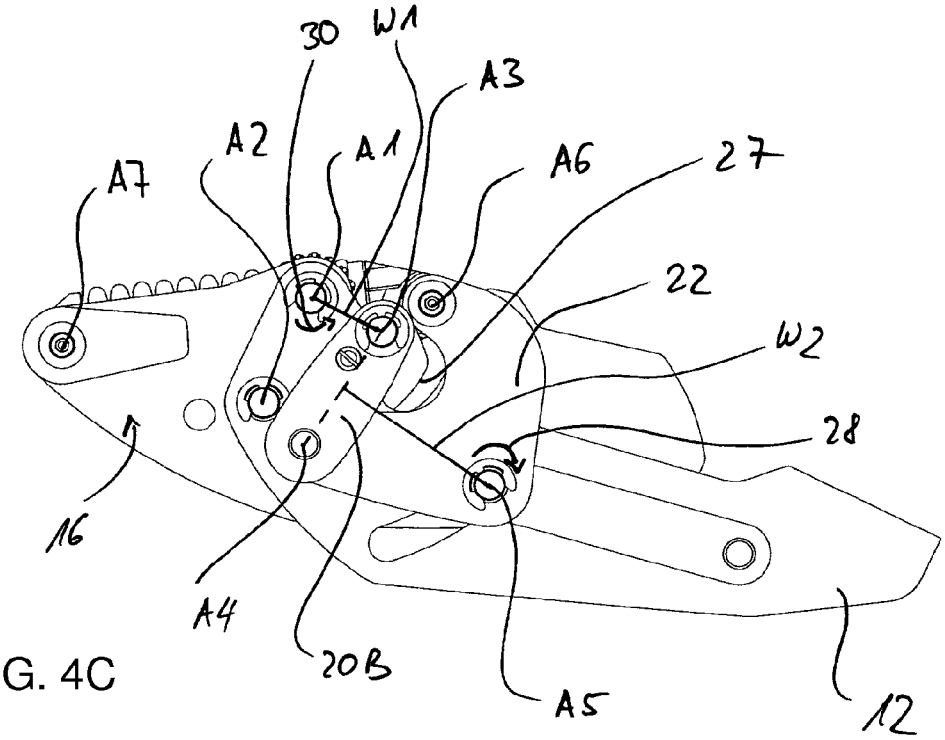
FIG. 4C is a side view according to FIG. 4A, in the inclined position.
Figure 5B:
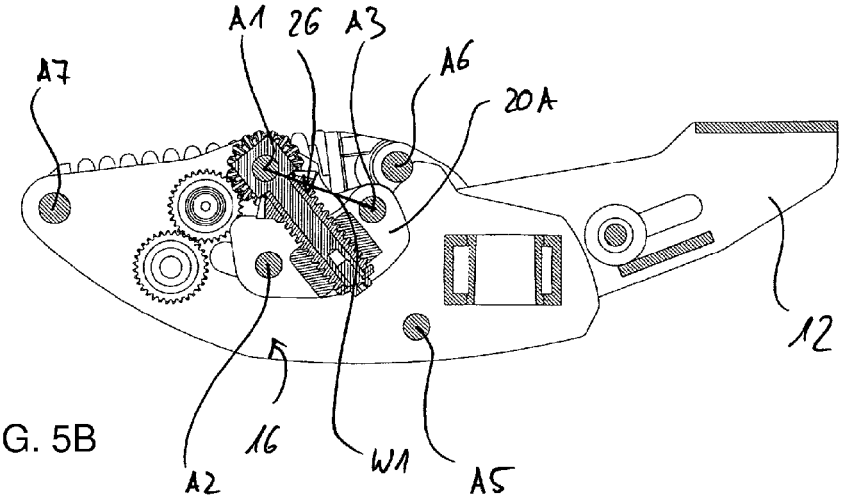
Figure 5C:
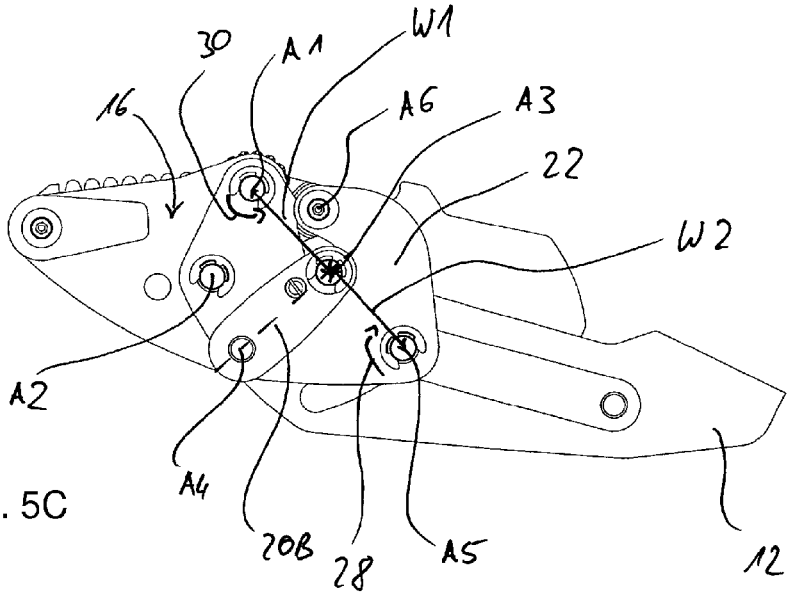
Figure 6A:
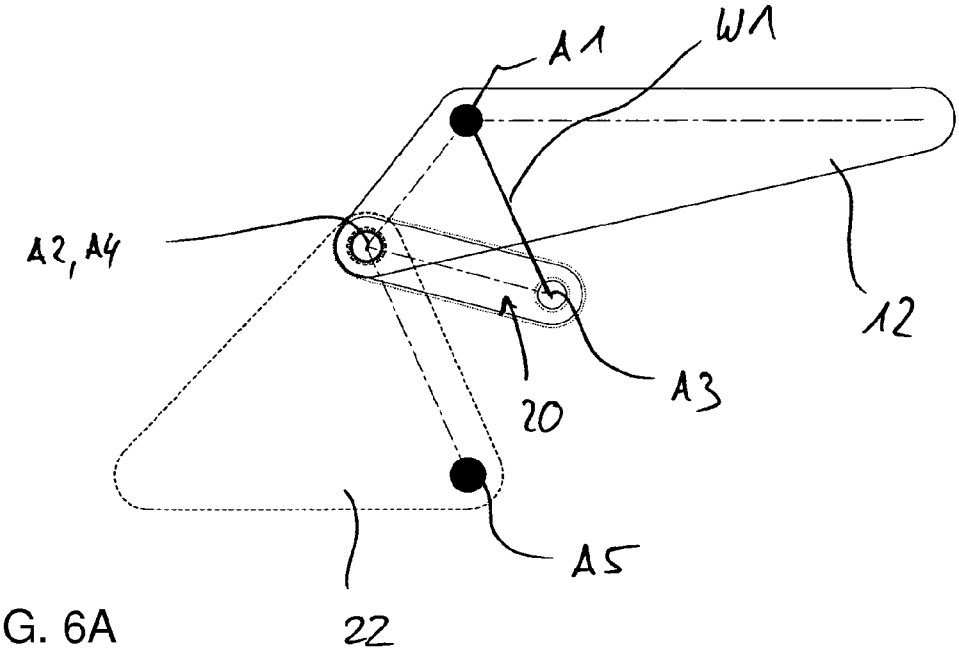
FIG. 6A is a diagrammatic illustration of the adjusting mechanism in order to illustrate its method of operation for the case of the "heavy" weight setting, in the basic position (upright back position)
Figure 6B:
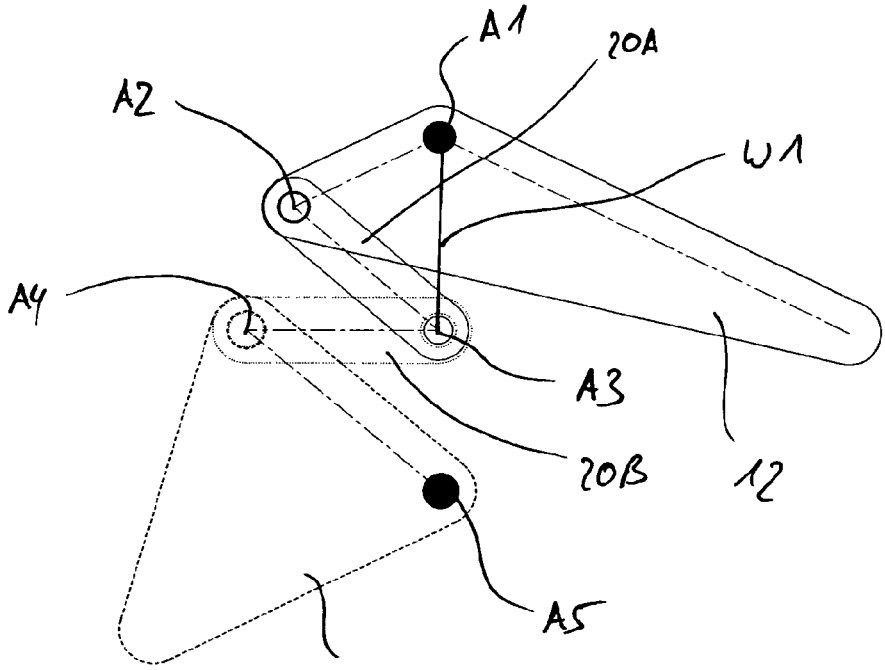
FIG. 6B is a diagrammatic illustration of the adjusting mechanism according to FIG. 6A in the "heavy" setting, in the inclined position (backrest inclined backward)
Figure 7A:
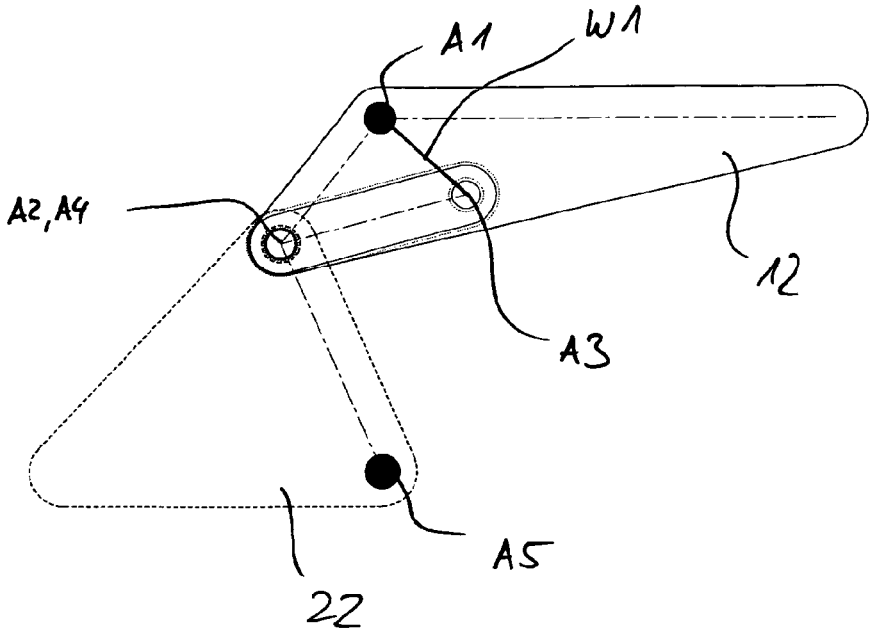
FIG. 7A is an illustration, which corresponds to FIG. 6A, of the adjusting mechanism in the basic position, in the case of the "light" weight setting.
Figure 7B:
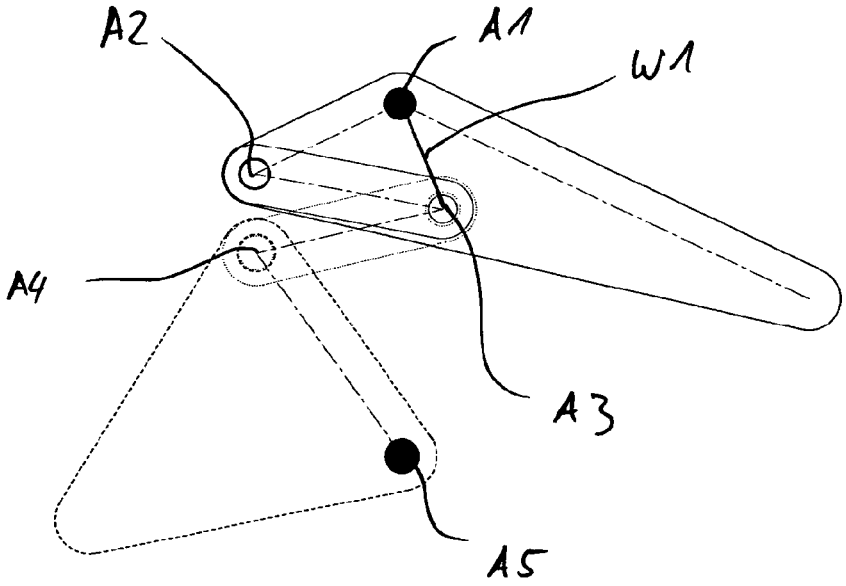
FIG. 7B is an illustration, which corresponds to FIG. 6B, in the "light" weight setting, in the inclined position.

The method of operation of the adjusting mechanism for setting the restoring force will now be explained using FIGS. 4A to 4C for a "light" weight setting and using FIGS. 5A to 5C for a "heavy" weight setting. The basic method of operation also results from FIGS. 6A, 6B which correspond to FIGS. 4A, 4C for the "light" weight setting. Accordingly, FIGS. 7A, 7B correspond to the "heavy" weight setting of FIGS. 5A, 5C.

In the basic position ("A" Figs.), in which the back support 12 is in the unloaded, non-inclined initial position (substantially horizontal position of the back support 12 and upright position of the back 2), the scissor arms 20A, 20B are oriented parallel to one another, and the articulation pin A4 and the setting pin A2 are therefore aligned with one another. The active lever length W1 can be changed via the spindle mechanism 26, by the first lever arm 20A being pivoted about the setting pin A2 (see, for example, transition of the "light" weight setting according to FIG. 6A to the "heavy" weight setting according to FIG. 7A, or FIGS. 4A, 5A which correspond hereto).

The special advantage of this embodiment can be seen in the fact that the adjustment takes place in a virtually weight-free manner, since no spring forces are exerted in this basic position. As a consequence of the self-locking action of the spindle mechanism, the position of the scissor pin A3 is fixed in the desired position and is also maintained in the case of an adjustment of the inclination.

A spring force (compressive force) is transmitted from the spring element to the action pin A6, which leads to a torque 28 about the pivot pin A5 in accordance with the arrow which is shown. The torque 28 is transmitted via the articulation bolt (articulation pin A4) to the second pivoting arm 20B, from the latter to the first pivoting arm 20A, and via the latter ultimately to the back support 12. Here, a restoring torque 30 is exerted according to the arrow about the support pin A1 which defines the desired restoring force counter to an adjustment of the inclination of the backrest 2. The restoring torque 30 depends on the active lever length W1 which is set. In the case of the small active lever length W1 which is set in the light weight setting, a comparatively low restoring force is active and, in the case of the large active lever length W1 which is set according to FIG. 5A, a considerably greater restoring force is active. Here, the magnitude of the restoring force depends solely on the setting of the active lever length W1. The spring force which is exerted by the spring element 24 is constant.

An adjustment of the inclination leads to a rotational movement of the articulation element about the pivot pin A5 in the opposite direction to the torque 28 which is exerted by the spring element. As a result, the spring element 24 is compressed in the exemplary embodiment. As can be gathered from the comparison of first FIGS. 4A, 4C and secondly FIGS. 5A, 5C, the spring element is compressed here in the "light" weight setting by a smaller distance than in the "heavy" weight setting. Via the "chain of links", formed by the scissors 20 and the articulation element 22, a different "transmission ratio" is therefore set on the basis of the different active lever lengths W1, that is to say the adjusting travels of the spring element 24 differ in the weight settings in the case of an identical adjustment of the inclination.

Overall, the described embodiment achieves a compact mechanism for weight setting which is distinguished, in particular, by a virtually force-free weight setting in the basic position. Furthermore, a comparable profile of the restoring force is achieved over the adjusting travel in the case of an adjustment of the inclination, independently of the performed weight setting. In particular, the ratios of the restoring forces in the upright and the inclined end positions are at least similar to one another in a "light" weight setting and in a "heavy" weight setting, and the profile of the restoring force over the inclination travel is also at least largely independent of the performed weight setting.

List of Designations

2 Back
4 Seat
6 Adjusting mechanism
8 Standing tube
12 Back support
14 Seat support
16 Support
18 Side cheek
20 Adjusting element
20A First scissor arm
20B Second scissor arm
22 Articulation element
24 Spring element
26 Spindle mechanism
27 Indentation
28 Torque
30 Restoring torque
A1 Support pin
A2 Setting pin
A3 Scissor pin
A4 Articulation pin
A5 Pivot pin
A6 Action pin
A7 Supporting pin

The invention claimed is:

1. An adjusting mechanism for setting a restoring force acting on a backrest of a chair, the adjusting mechanism comprising:

a spring element for generating the restoring force;

a support having a support pin;

a backrest support mounted on said support such that said backrest support can be pivoted about said support pin;

an adjusting element configured in a manner of scissors having a first scissor arm, a second scissor arm, a setting pin and a scissor pin, said first and second scissor arms connected to one another such that they can be rotated about said scissor pin, said first scissor arm mounted on said backrest support such that said first scissor arm can be pivoted about said setting pin, a spring force acting on said second scissor arm from said spring element; and a setting element, a first active lever length being defined between said support pin and said scissor pin, said first active lever length can be changed with an aid of said setting element for setting the restoring force by pivoting of said adjusting element about said setting pin, said first active lever length being set and therefore the restoring force being set, such that both are constant during inclination of the backrest.

2. The adjusting mechanism according to claim 1, wherein said spring element always acts on a same position independently of a setting, and the position is also unchangeable in a case of an adjustment of an inclination.

3. The adjusting mechanism according to claim 1, further comprising:

an articulation pin; and an articulation element, on which said spring element acts and is connected to said second scissor arm such that said articulation element can be pivoted about said articulation pin.

4. The adjusting mechanism according to claim 3, wherein said articulation element has a pivot pin and is mounted on said support such that said articulation element can be rotated about said pivot pin, and said spring element exerts a torque on said articulation element with regard to a rotation about said pivot pin.

5. The adjusting mechanism according to claim 3, wherein said articulation element has an indentation, into which said scissor pin can pivot.

6. The adjusting mechanism according to claim 3, wherein in an unloaded basic position, said first and second scissor arms extend at least largely parallel to one another.

7. The adjusting mechanism according to claim 1, further comprising a locking element being active between said support pin and said scissor pin in order to fix the first active lever length which is set via said setting element.

8. The adjusting mechanism according to claim 7, wherein said locking element is active automatically after a setting via said setting element.

9. The adjusting mechanism according to claim 1, wherein said setting element has a self-locking spindle as a locking element.

10. An adjusting mechanism for setting a restoring force acting on a backrest of a chair, the adjusting mechanism comprising:

a spring element for generating the restoring force;

a support having a support pin;

a backrest support mounted on said support such that said backrest support can be pivoted about said support pin;

an adjusting element configured in a manner of scissors having a first scissor arm, a second scissor arm, a setting pin and a scissor pin, said first and second scissor arms connected to one another such that they can be rotated about said scissor pin, said first scissor arm mounted on said backrest support such that said first scissor arm can be pivoted about said setting pin, a spring force acting on said second scissor arm from said spring element;

a setting element, a first active lever length being defined between said support pin and said scissor pin, said first active lever length can be changed with an aid of said setting element for setting the restoring force by pivoting of said adjusting element about said setting pin; and a position of said support pin, said setting pin and said scissor pin with respect to one another is fixed mechanically after setting has taken place via said setting element.

11. The adjusting mechanism according to claim 4, wherein said pivot pin is disposed below said support pin and said adjusting element is disposed between said pivot pin and said support pin.

12. The adjusting mechanism according to claim 4, wherein a second active lever length is defined between said pivot pin and said second scissor arm, the second active lever length being perpendicular with respect to said second scissor arm, the second active lever length being increased during a pivoting of said adjusting element about said setting pin when the first active lever length is decreased, and vice versa.

13. The adjusting mechanism according to claim 1, wherein during pivoting of said back support about said support pin out of a basic position into an inclined position, said adjusting element moves out of a closed position with said first and second scissor arms extending in parallel into an open position with said first and second scissor arms opened in a V-shaped manner.

14. An office chair, comprising:

a backrest;

an adjusting mechanism for setting a restoring force acting on said backrest, said adjusting mechanism containing:

a spring element for generating the restoring force;

a support having a support pin;

a backrest support mounted on said support such that said backrest support can be pivoted about said support pin;

an adjusting element configured in a manner of scissors having a first scissor arm, a second scissor arm, a setting pin and a scissor pin, said first and second scissor arms connected to one another such that they can be rotated about said scissor pin, said first scissor arm mounted on said backrest support such that said first scissor arm can be pivoted about said setting pin, a spring force acting on said second scissor arm from said spring element; and a setting element, a first active lever length being defined between said support pin and said scissor pin, the first active lever length can be changed with an aid of said setting element for setting the restoring force by pivoting of said adjusting element about said setting pin, said first active lever length being set and therefore the restoring force being set, such that both are constant during inclination of the backrest.

* * * * *